US007959282B2

(12) United States Patent
Custer

(10) Patent No.: US 7,959,282 B2
(45) **Date of Patent: *Jun. 14, 2011**

(54) CONCENTRATED ENERGY SOURCE

(75) Inventor: Eric J. Custer, Albion, IN (US)

(73) Assignee: Summit Business Products, Inc., Columbia City, IN (US)

( * ) Notice: Subject to any disclaimer, the term of this patent is extended or adjusted under 35 U.S.C. 154(b) by 665 days.

This patent is subject to a terminal disclaimer.

(21) Appl. No.: 11/961,643

(22) Filed: Dec. 20, 2007

(65) Prior Publication Data

US 2009/0160923 A1 Jun. 25, 2009

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 3,983,039 | A | 9/1976 | Eastland | |
| 4,303,924 | A | 12/1981 | Young, Jr. | |
| 4,644,899 | A | 2/1987 | Glaus | |
| 4,672,258 | A | 6/1987 | Konishi | |
| 5,216,283 | A | 6/1993 | Lin | |
| 5,861,806 | A | 1/1999 | Vories et al. | |
| 6,102,696 | A | 8/2000 | Osterwalder et al. | |
| 6,161,941 | A * | 12/2000 | Tait et al. | 362/235 |
| 6,164,757 | A | 12/2000 | Wen et al. | |
| 6,170,963 | B1 | 1/2001 | Arnold | |
| 6,543,890 | B1 | 4/2003 | Ylitalo et al. | |
| 6,561,640 | B1 | 5/2003 | Young | |
| 6,621,087 | B1 | 9/2003 | Bisges et al. | |
| 6,641,284 | B2 | 11/2003 | Stopa et al. | |
| 6,719,558 | B2 | 4/2004 | Cao | |
| 6,719,559 | B2 | 4/2004 | Cao | |
| 6,739,716 | B2 | 5/2004 | Richards | |
| 6,755,649 | B2 | 6/2004 | Cao | |
| 6,783,227 | B2 | 8/2004 | Suzuki et al. | |
| 6,880,954 | B2 | 4/2005 | Ollett et al. | |
| 7,214,952 | B2 | 5/2007 | Klipstein et al. | |
| 7,470,921 | B2 | 12/2008 | Custer | |
| 2002/0101491 | A1 | 8/2002 | Ervin et al. | |
| 2002/0172916 | A1 | 11/2002 | Cao | |
| 2002/0177099 | A1 | 11/2002 | Cao | |
| 2003/0011669 | A1 | 1/2003 | Tsuboi et al. | |
| 2003/0035037 | A1 | 2/2003 | Mills et al. | |

(Continued)

FOREIGN PATENT DOCUMENTS

| | | |
|---|---|---|
| DE | 20201493 | 5/2003 |

(Continued)

OTHER PUBLICATIONS

Office action dated Apr. 23, 2008 regarding U.S. Appl. No. 11/231,227, 24 pages.

(Continued)

*Primary Examiner* — Laura E Martin
(74) *Attorney, Agent, or Firm* — Senniger Powers LLP

(57) ABSTRACT

Apparatus for curing a substance. The apparatus includes a diode for emitting electromagnetic energy at a frequency selected to cure the substance and a culminator positioned to receive at least a portion of the electromagnet energy emitted by the diode. The culminator is selected to concentrate and intensify the received energy and to direct the energy toward an area of the substance. The area has a length and a width less than the length.

11 Claims, 7 Drawing Sheets

U.S. PATENT DOCUMENTS

| | | | | |
|---|---|---|---|---|
| 2003/0184631 | A1 | 10/2003 | Suzuki et al. | |
| 2003/0222961 | A1* | 12/2003 | Nakajima | 347/102 |
| 2004/0135159 | A1 | 7/2004 | Siegel | |
| 2004/0164325 | A1 | 8/2004 | Siegel | |
| 2004/0166249 | A1 | 8/2004 | Siegel | |
| 2004/0170019 | A1 | 9/2004 | Tamai | |
| 2004/0179079 | A1* | 9/2004 | Yokoyama | 347/102 |
| 2004/0238111 | A1 | 12/2004 | Siegel | |
| 2005/0042390 | A1 | 2/2005 | Siegel | |
| 2005/0068397 | A1 | 3/2005 | Yokoyama | |
| 2005/0093952 | A1 | 5/2005 | Hoshino | |
| 2005/0099478 | A1 | 5/2005 | Iwase | |
| 2005/0104946 | A1 | 5/2005 | Siegel | |
| 2005/0154075 | A1 | 7/2005 | Siegel | |
| 2005/0218468 | A1 | 10/2005 | Owen et al. | |
| 2005/0231983 | A1 | 10/2005 | Dahm | |
| 2005/0280683 | A1 | 12/2005 | Custer | |
| 2006/0275733 | A1 | 12/2006 | Cao | |
| 2007/0184141 | A1* | 8/2007 | Custer | 425/174 |

FOREIGN PATENT DOCUMENTS

| | | | |
|---|---|---|---|
| EP | 1428668 | A2 | 6/2004 |
| JP | 62159113 | A | 7/1987 |
| JP | 1163412 | A | 6/1989 |
| JP | 1274572 | A | 11/1989 |
| JP | 2001007406 | A | 1/2001 |
| JP | 2002153423 | A | 5/2002 |
| JP | 2002184209 | A | 6/2002 |
| JP | 2002314151 | A | 10/2002 |
| JP | 2002329893 | A | 11/2002 |
| JP | 2004181941 | A | 7/2004 |
| JP | 2004363352 | A | 12/2004 |
| JP | 2005104108 | A | 4/2005 |
| WO | 2004011848 | A1 | 2/2004 |
| WO | 2004056581 | A1 | 7/2004 |
| WO | 2005093858 | A2 | 10/2005 |
| WO | 2008121808 | A1 | 10/2008 |

OTHER PUBLICATIONS

Product Information, Phoseon Technology, Radion Solid State US—Transforming UV Technology, date unknown.

Product Information, UV Process Supply, Inc., "UV LED Cure-All," 2004.

Product Information, Norlux Corporation, "UV Markets," 2004.

* cited by examiner

CONCENTRATED ENERGY SOURCE

BACKGROUND

This invention generally relates to a concentrated energy source and, more particularly, to a culminated ultraviolet light-emitting diode device for curing substances such as printer ink and adhesives.

Electromagnetic energy, particularly energy in an ultraviolet (UV) light frequency range has been found to speed curing of some substances, including fluids such as inks, coatings, and adhesives. Many of these fluids include UV photo initiators that convert monomers in the fluids into linking polymers to solidify the monomer material when the fluids are exposed to UV light. Conventional apparatus for curing substances using UV light sources include lamps and/or light-emitting diodes (LEDs) that produce light in a UV frequency range selected to optimize curing times. An LED is a type of electronic semiconductor device that emits light when an electric current passes through it.

Ink jet printers occasionally include LEDs to speed ink curing rates. Ink jet printers spray droplets of ink from a printer head onto a substrate such as film and paper. Ultraviolet LEDs direct UV light toward the ink on the substrate at a wavelength selected to speed ink curing. In the past, these LED apparatus have been inefficient in delivering sufficient energy to the ink. As a result, conventional printers having UV LED apparatus for curing ink have required LED arrays having numerous LEDs, resulting in printers of increased size, complexity and cost. Moreover, these inefficiencies have resulted in increased power usage. Conventional LED apparatus provide relatively low energy density, resulting in slow curing times. Thus, a need exists for an energy source that provides sufficient energy density to cure substances quickly. Further, there is a need for an energy source that efficiently uses energy. Still further, there is a need for an energy source that provides apparatus of smaller size, less complexity and lower cost.

BRIEF SUMMARY

The present invention relates to apparatus for curing a substance. The apparatus comprises a diode for emitting electromagnetic energy at a frequency selected to cure the substance and a culminator positioned to receive at least a portion of the electromagnet energy emitted by the diode. The culminator is selected to concentrate and intensify the received energy and to direct the energy toward an area of the substance. The area has a length and a width less than the length.

In another aspect, the present invention relates to apparatus for curing a substance. The apparatus includes a plurality of diodes. Each of the diodes adapted for emitting electromagnetic energy at a frequency selected to cure the substance. In addition, the apparatus includes a culminator positioned to receive at least a portion of the electromagnet energy emitted by each of the plurality of diodes. The culminator is selected to concentrate and intensify the received energy and to direct the energy toward at least a portion of the substance.

In still another aspect, the invention includes apparatus for curing a substance comprising a diode for emitting electromagnetic energy at a frequency selected to cure the substance and a culminator positioned to receive at least a portion of the electromagnet energy emitted by the diode to concentrate and intensify the received energy and to direct the energy toward at least an area of the substance. The culminator has a longitudinal axis extending laterally with respect to the electromagnetic energy emitted by the diode.

Further, the present invention relates to apparatus for curing a substance. The apparatus comprises a diode for emitting electromagnetic energy at a frequency selected to cure the substance and a culminator positioned to receive at least a portion of the electromagnet energy emitted by the diode to concentrate and intensify the received energy and to direct the energy toward at least an area of the substance. The culminator has a circular cross section when viewed from a position laterally offset from a centerline of the diode.

In a further aspect, the present invention relates to apparatus for curing a substance. The apparatus includes a body having a recess comprising a plurality of faces. Each of the faces a common area of the substance. The apparatus also includes a plurality of diodes. Each of the diodes is positioned on one of the faces of the recess for emitting light energy toward the area of the substance. In addition, the apparatus comprises a plurality of culminators. Each of the culminators is positioned to receive at least a portion of the electromagnet energy emitted by at least one of the diodes to concentrate and intensify the received energy and to direct the energy toward the area of the substance.

Other aspects of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
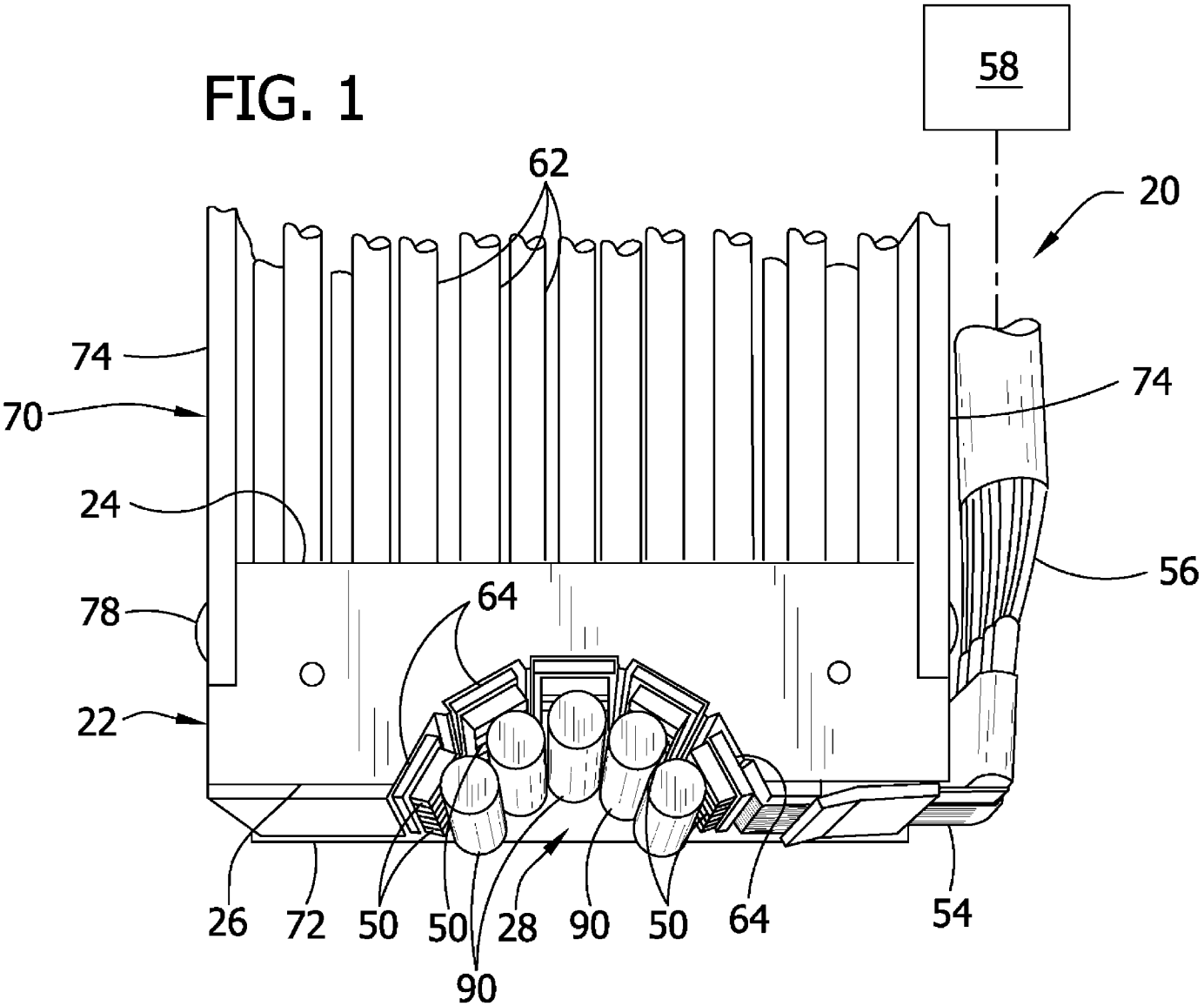
FIG. 1 is a fragmentary perspective view of a portion of an apparatus of one embodiment of the present invention.

Referring now to the drawings and in particular FIG. 1, a concentrated energy source and more particularly to an ultraviolet light-emitting diode apparatus for curing substances such as ink deposited on a substrate is designated in its entirety by the reference number 20. The apparatus 20 includes a base, generally designated by 22, having a top 24, and a bottom 26 opposite the top. Although the top 24 is referred to as the "top" and the bottom 26 is referred to as the "bottom", those skilled in the art will appreciate that the bottom of the base 22 is the side normally facing a substance to be cured and the top of the base is a side generally opposite the bottom. The bottom 26 of the base 22 may be oriented downward as shown or oriented in other directions including generally sideways and/or upward depending on the orientation of the curable substance. A recess, generally designated by 28, extends into the base 22 from the bottom 26. The base 22 may be constructed of any thermally conductive material, such as aluminum, copper, brass, polymer, cobalt, or a combination of thermally conductive materials. For example, in one embodiment the base 22 may comprise an aluminum core coated with a thermally conductive polymer. In the illustrated embodiment, the base 22 is an aluminum block and the recess 28 is machined in it. The recessed base 22 may be formed by any suitable process, such as extrusion, milling or casting.

Figure 2:
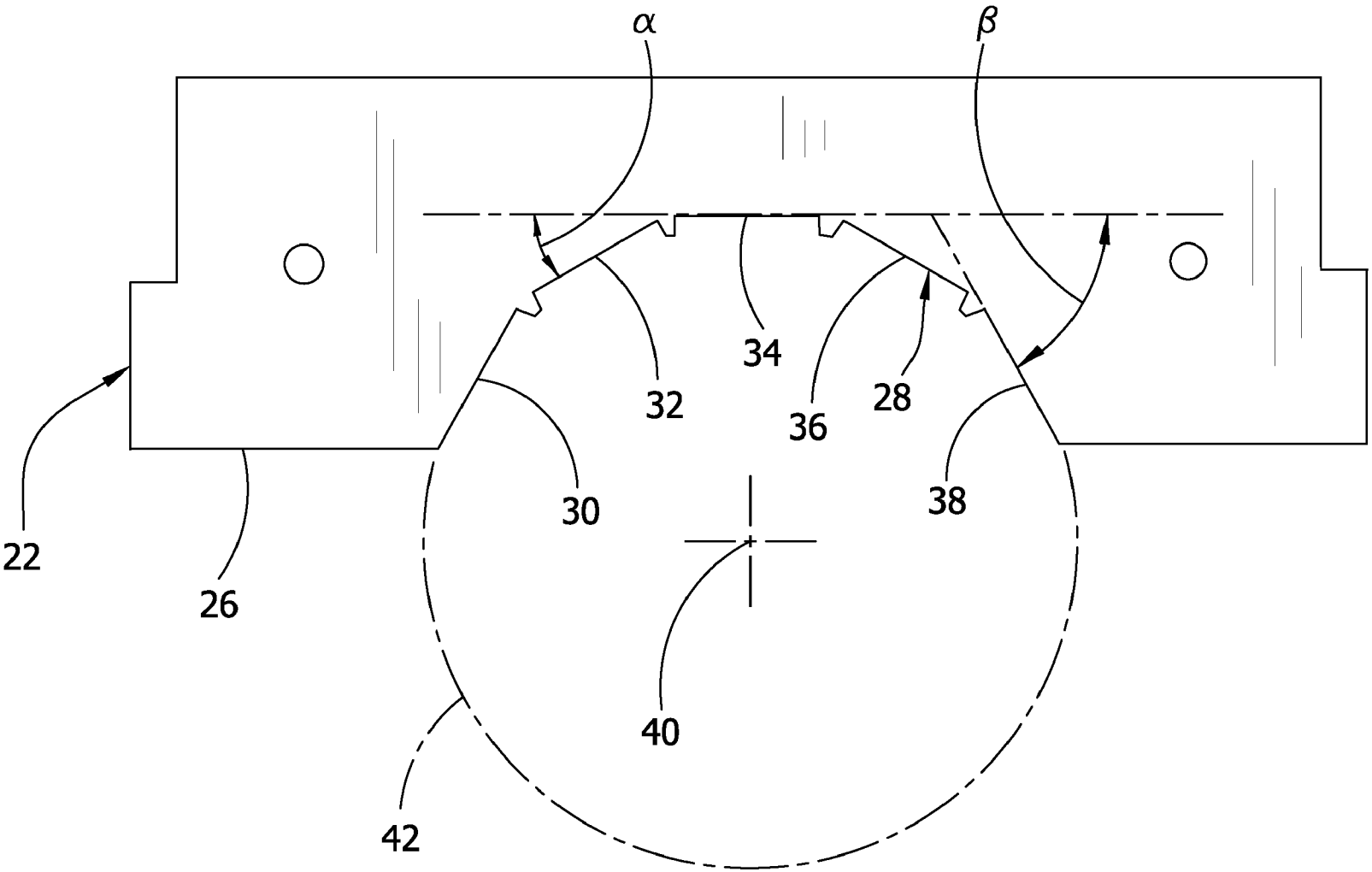
FIG. 2 is a side elevation of a base of the apparatus.

As shown in FIG. 2, in one embodiment the recess 28 has five generally planar faces 30, 32, 34, 36, 38, spaced around an imaginary centerline 40 extending parallel to and below the bottom 26 of the base 22. Each of the faces 30, 32, 34, 36, 38 extends in a plane that is tangent to an imaginary cylinder 42 centered on the centerline 40. Although the cylinder 42 may have other diameters without departing from the scope of the present invention, in one embodiment the cylinder has a diameter of about 2 inches, more particularly a diameter of about 1.5 inches, and still more particularly a diameter of about 1.542 inches. In one embodiment, the central face 34 extends parallel to the bottom 26 of the base 22. The faces 32, 36 adjacent the central face 34 extend at an angle $\alpha$ measured with respect to the central face. In one embodiment, the angle $\alpha$ is about 30°, more particularly about 32.4°, and still more particularly about 32.399°. The outer faces 30, 38 extend at an angle $\beta$ measured with respect to the central face 34. In one embodiment, the angle $\beta$ is about 60°, more particularly about 64°, and still more particularly about 63.877°. Although it is envisioned that the faces 30, 32, 34, 36, 38 may have other shapes without departing from the scope of the present invention, in one embodiment each of the faces has a generally rectangular shape. Further, although the faces 30, 32, 34, 36, 38 may have other lengths without departing from the scope of the present invention, in one embodiment, each of the faces has a length equal to that of the base (e.g., about 3 inches). Those skilled in the art will appreciate that the recess may have fewer or more faces without departing from the scope of the present invention. It is also envisioned that in some embodiments the recess may be asymmetric.

As further illustrated in FIG. 1, a plurality of LEDs 50 are mounted on each face 30, 32, 34, 36, 38 of the base 22. Although other arrangements of LEDs 50 are envisioned as being within the scope of the present invention, in one embodiment nine LEDs are mounted in a substantially straight row on the central face 34 and each of the outer faces 30, 38, and ten LEDs are mounted in a substantially straight row on the faces 32, 36 adjacent the central face. The rows of LEDs 50 are staggered. As will be appreciated by those skilled in the art, staggering the LEDs 50 provides for more uniform light distribution. Moreover, in some instances staggering the LEDs 50 results in a more compact LED arrangement and a more concentrated light source. In one embodiment, the LEDs 50 may be UV LEDs providing UV light at a frequency of about 365 nanometers (nm) for curing UV curable substances such as inks including UV photo initiators optimally activated by UV light at that frequency. As will be appreciated by those skilled in the art, electromagnetic energy sources (e.g., LEDs) producing energy at other frequencies may be used to cure substances that are activated by energy at those other frequencies. In one embodiment, the UV LEDs 50 are pigmented so that they are visible to an observer when in operation so that operation may be visually verified. In an alternative embodiment, the LEDs 50 may include other types of LEDs such as LEDs that emit visible light. In one exemplary embodiment, each LED 50 is a Part No. NCSU033A light-emitting diode, available from Nichia Corporation located in Japan.

The LEDs 50 are shown as relatively large, single point light sources, however, it is envisioned that the LEDs 50 may be constructed as a plurality of point light sources grouped together in a unit. It is believed that using selectively grouped LEDs will reduce component cost because the power output by individual LEDs in the group can vary more without affecting the total power output by the group. For example, one contemplated apparatus comprises LED packs consisting of four LEDs, some selected from LEDs producing between 190 milliWatts (mW) and 230 mW, some selected from LEDs producing between 230 mW and 270 mW and some selected from LEDs producing between 270 mW and 310 mW, so that the combined unit produces a total power output between about 102 milliWatts (mW) and about 2500 mW and at a frequency of about 365 nm. The LEDs may be produced as a unit having a common housing, lens and power input leads.

An electrical lead (not shown) extends longitudinally along each face 30, 32, 34, 36, 38 for operatively connecting each of the light-emitting diodes 50 to leads such as a ribbon cable 54 connected to a bundle of wires 56 connected to a power supply 58. The leads carry electricity to the light-emitting diodes 50 to power the diodes, causing them to emit UV energy at a particular frequency. In one embodiment (not shown), it is envisioned that each lead is formed directly on the base 22 as a printed circuit. In the illustrated embodiment, the face 38 includes a recess 60 for accommodating the flexible circuit (i.e., ribbon cable 54). A controller (not shown) such as a conventional control card may be operatively positioned between the power supply 58 and the LEDs 50 to control the current supplied to the LEDs. The power supply 58 and controller may provide constant current or adjustable pulsed current. As will be appreciated by those skilled in the art, the LEDs 50 may be overdriven by the power supply 58 and controller to obtain greater power from the LEDs.

Heat pipes 62 extend from the top 24 of the base 22 to draw heat away from the base. Each heat pipe 62 includes a hollow, copper tube sealed at both ends. The pipe 62 is filled with a conventional heat pipe fluid such as a wicking material in a water-based solution. As will be appreciated by those skilled in the art, the heat pipes 62 draw heat away from the base 22 to maintain the apparatus 20 and the substrate (not shown) at temperatures below target temperatures selected to improve performance and/or prevent damage. In one embodiment, the heat pipes 62 are directly attached to the thermal conductor strips 64 on each face 30, 32, 34, 36, 38 of the base 22. The conductor strips 64 conduct heat away from the light-emitting diodes 50 to the base 22 and heat pipes 62. In other alternative embodiments, the heat pipes 62 may be replaced with other cooling systems. For example, the base may include conventional cooling fins to remove heat from the apparatus. Alternatively, the base may include cooling passages through which coolant may be circulated to remove heat.

Figure 3:
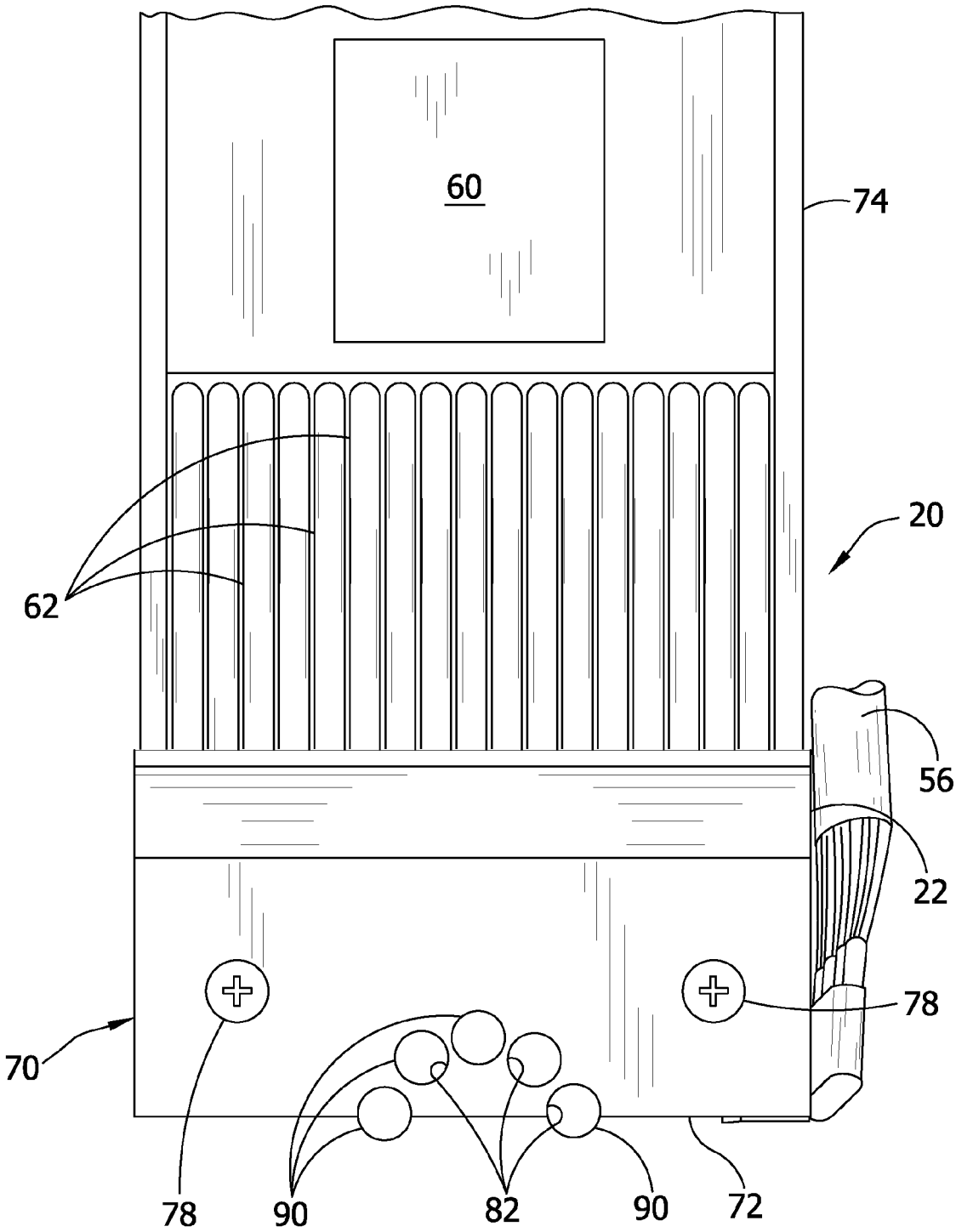
FIG. 3 is a fragmentary side elevation of the apparatus.

As further illustrated in FIG. 1, the apparatus 20 includes a support, generally designated by 70, having plates 72 (one of which is omitted in FIG. 1 for viewing) on each side of the base 22. Brackets 74 are attached to each side of the base 22 for supporting a fan 60 above the heat pipes 62 as shown in FIG. 3 to improve heat removal from the base. Thus, in the illustrated embodiment the heat pipes 62 are used as active cooling devices in a forced air convective cooling system. Fasteners 78 are provided to connect the brackets 74 and plates 72 to the base 22. The support 70 may be used to mount the apparatus 20.

As shown in FIG. 3, the support 70 includes openings 82 (e.g., recesses) for holding light culminators 90 in close proximity to the LEDs 50. In one embodiment, the culminators 90 are separate from the LEDs 50 and separate from any lens assembly packaged with the LEDs. In one embodiment, each light culminator 90 is formed as a cylinder. Although the culminator 90 may be made of other materials that are generally transparent to the frequency of energy being transmitted, such as a suitable polymer, a glass, quartz, or a ceramic, in one embodiment the culminator is formed from visually transparent quartz. As will be understood by those skilled in the art, the more transparent the culminator 90 is to the energy being transmitted, the more efficient the culminator will be and the lower the energy required from the LEDs 50. In one embodiment, the culminator 90 has a diameter of about 0.25 inch and a length equal to the length of the base (e.g., about 3 inches). One such culminator is available as Item No. 44653 from United States Plastic Corporation of Lima, Ohio. It is envisioned that the culminators 90 may have other shapes (e.g., an oval column, a semicircular column or an egg-shaped column) without departing from the scope of the present invention. It is further envisioned that the culminators 90 may have other dimensions including diameters between about ⅛ inch and about 2 inches or more. Although in the illustrated embodiment the number of light culminators 90 is equal to the number of rows of LEDs 50, those skilled in the art will appreciate that fewer or more culminators may be used without departing from the scope of the present invention.

Figure 4:
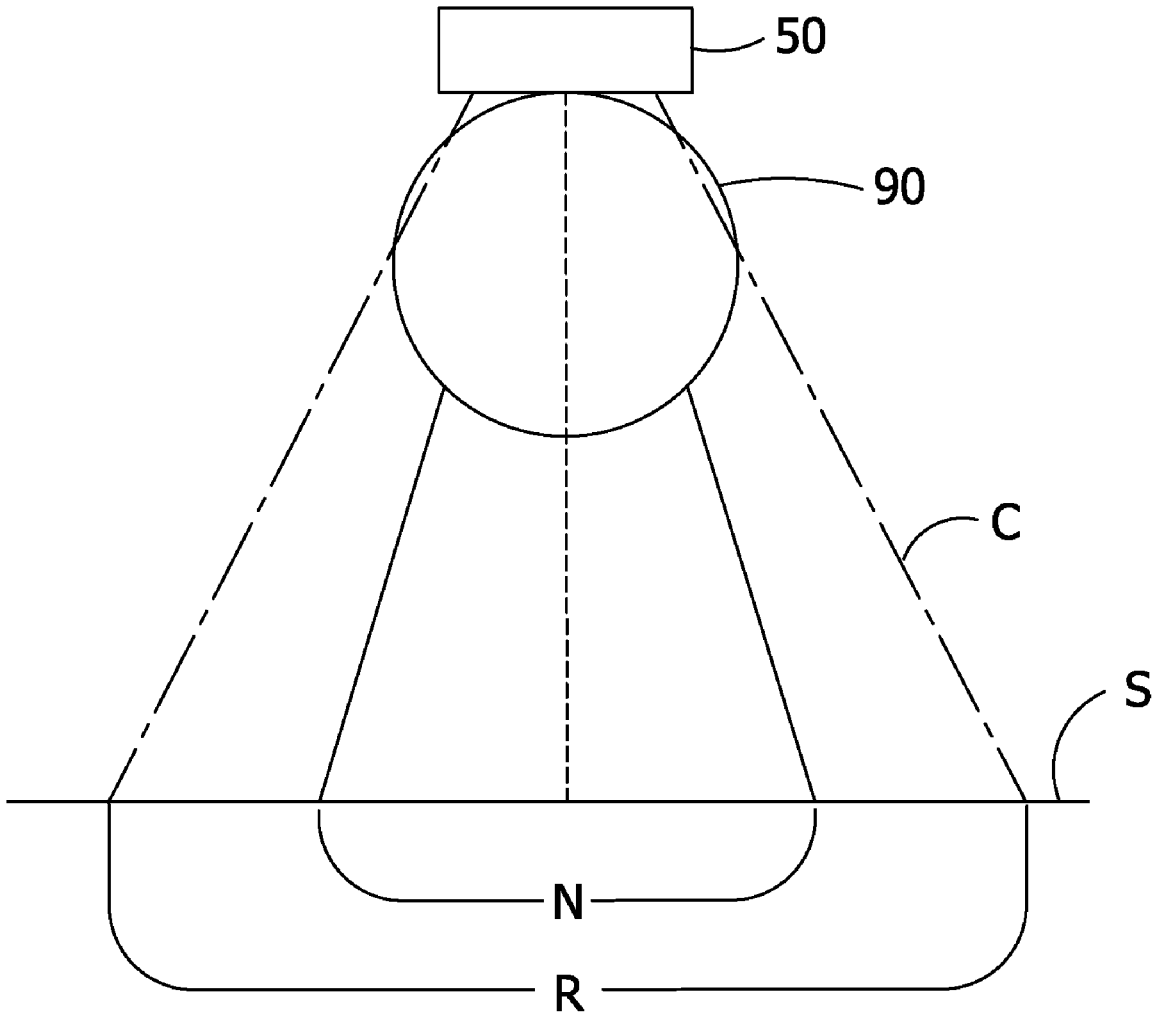
FIG. 4 is a schematic side elevation of one light-emitting diode and one light culminator.

The light culminators 90 are configured to direct and culminate, i.e., concentrate and intensify, the light emitted from the LEDs 50 of the device 20 as schematically illustrated in FIG. 4. The LEDs 50 emit light in a diverging pattern. Typically, the diverging pattern is a conical pattern designated by C in FIG. 4. For example, in one embodiment the LEDs 50 emit light that diverges in a 60° cone from the diode. The light emitted by the LED 50 falls on a surface S, such as the outer surface of the substance being cured. If the culminator 90 were not present, the light emitted by a single LED 50 would fall on a surface in a generally round pattern R. As will be appreciated by those skilled in the art, the round pattern will be generally circular or elliptical depending upon the angle at which the light falls on the surface S. The culminator 90 refracts the light rays emitted from the LED 50 so it bends around the axis of the culminator cylinder, thereby directing the light into a narrow strip pattern N. Because only small energy losses occur as the light passes through the culminator 90, about the same amount of energy falls on the smaller area of the narrow strip N than would otherwise fall on the larger area of the round pattern R. Thus, the light energy is concentrated in a smaller area and intensified by the culminator 90. As will be understood by those skilled in the art, because the culminators 90 intensify the energy, fewer LEDs 50 or lower power LEDs may be used.

The cylindrical culminators 90 direct the light into a narrow strip that is more intense than it would otherwise be in the selected area if the culminator were not present. The culminator shapes and materials may be selected to obtain a desired pattern of light having a desired intensity. In order to optimize LED usage, the culminator 90 is preferably positioned relative to the LED 50 so that all of the light in the cone C enters the culminator. This optimization may be achieved by selecting a sufficiently large culminator 90 and/or moving the culminator sufficiently close to the LED 50. In one embodiment, the culminator 90 is positioned in close proximity to the LED 50. For example, the culminator 90 may be positioned so it contacts the lens on the LED package. In one particular embodiment, the culminator 90 is spaced from the diode by a distance of about 1 millimeter (mm) and more particularly about 1.45 mm.

Figure 5:
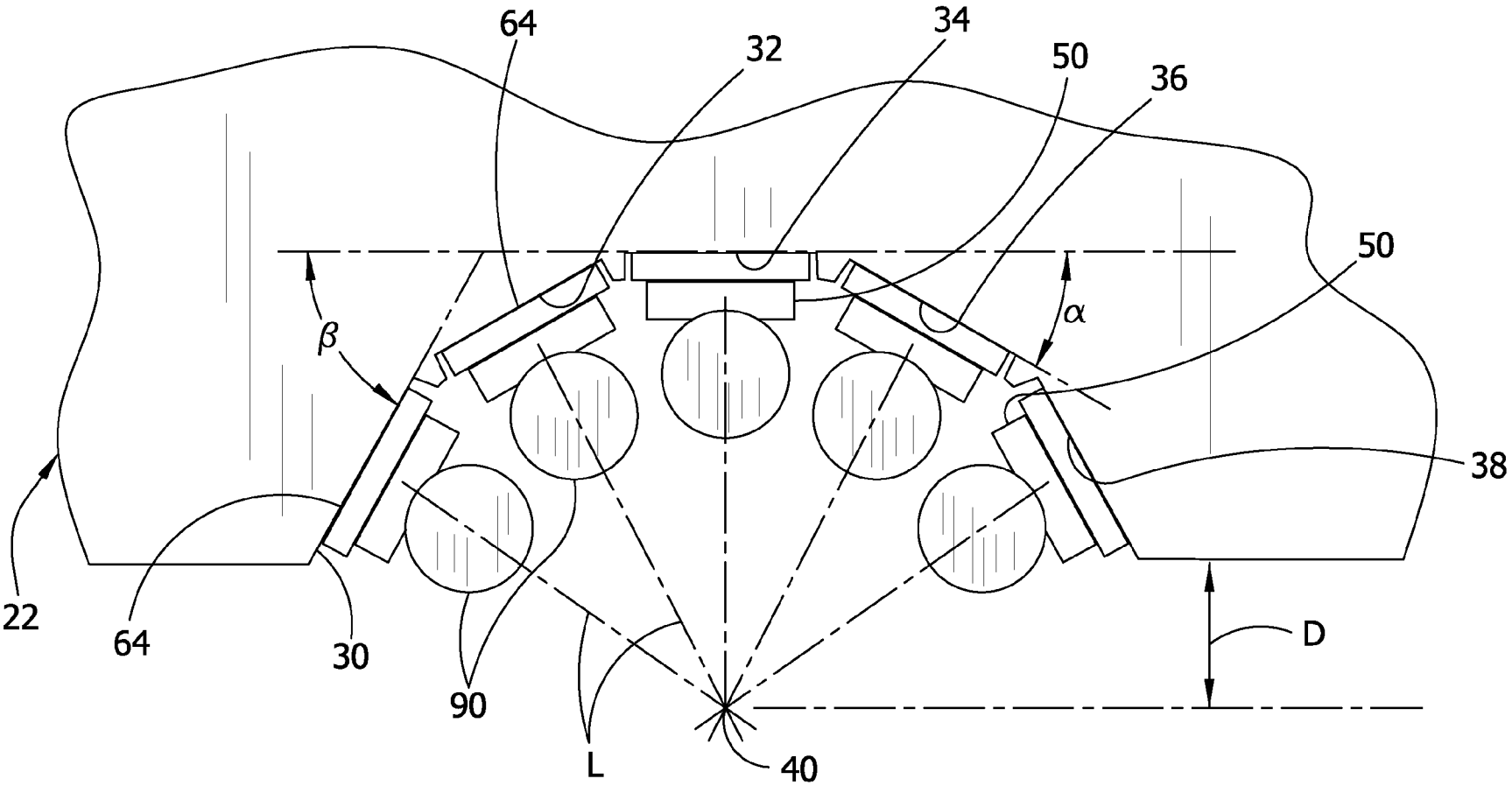
FIG. 5 is a fragmentary detail of the apparatus schematically illustrating the apparatus operation and layout.

As previously mentioned, the energy beam emitted from the LEDs 50 is general shaped in a cone. The most intense light emitted from the LED 50 travels along a beam centerline located generally along a center axis of the cone. As shown in FIG. 5, in one embodiment the angles α, β of the faces 30, 32, 34, 36, 38 of the base 22 are selected to aim the centerlines L of the LEDs 50 so they converge along the imaginary centerline 40 about which the faces are arranged. Thus, the most intense light is found along the imaginary centerline 40. To optimize energy transmission to the substance being cured, an area of the substance being cured is centered at the imaginary centerline. In some embodiments, the centerline 40 may be generally positioned at an upper surface of the curable substance, and in other embodiments, the centerline is positioned on a plane coincident with a central plane of the curable substance. As will be appreciated by those skilled in the art, the centerline 40 is preferably located below the base 22 of the apparatus 20 by some distance D. This distance D may be selected to permit some operational tolerance. For example, in the case of a printer, the distance D may be selected to compensate for substrate ripple and ink thickness to avoid ink smudging. In one embodiment, this distance D is selected to be about 1.5 mm.

Figure 6:
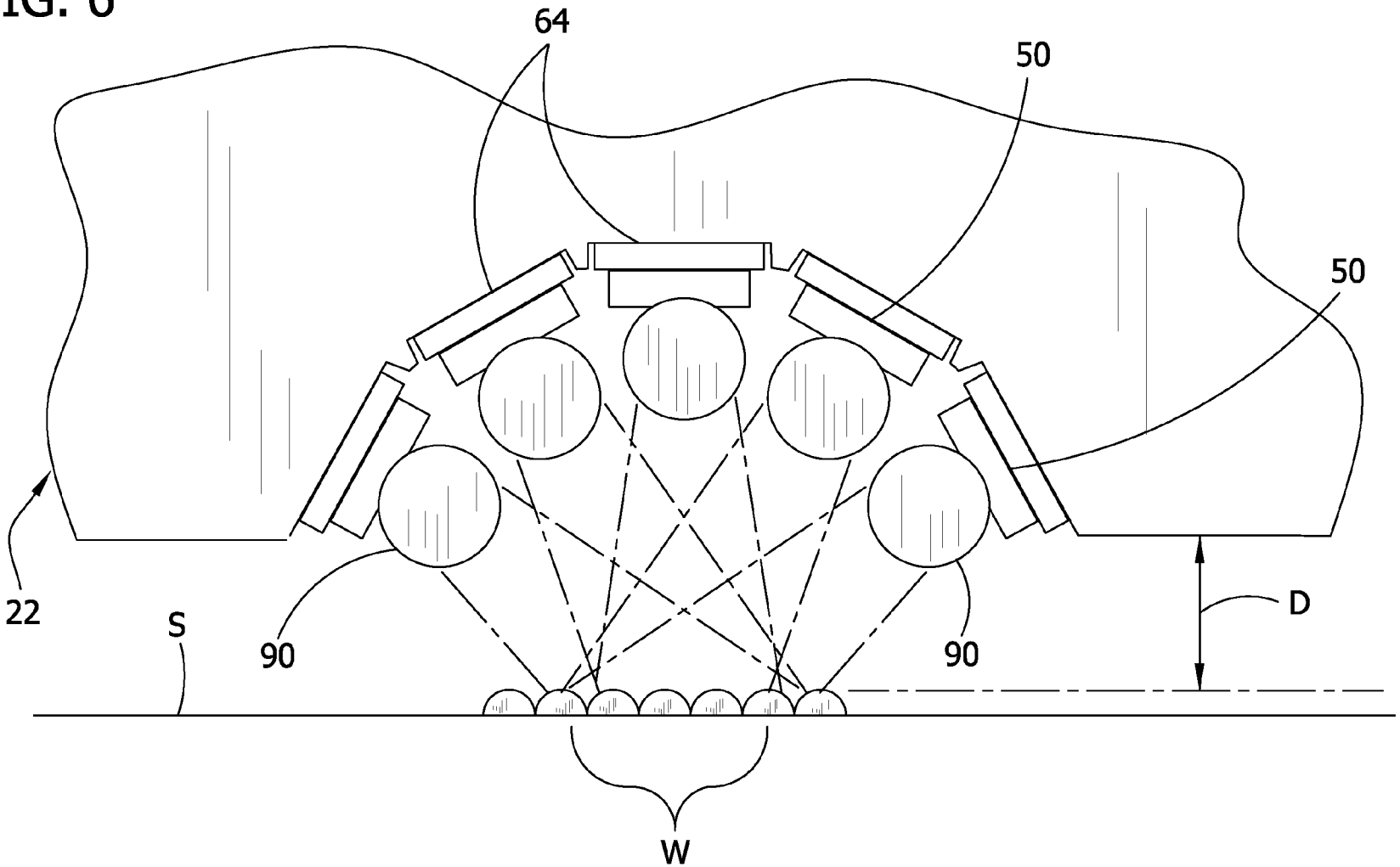
FIG. 6 is a fragmentary detail of the apparatus schematically illustrating the apparatus in operation.

As illustrated in FIG. 6, the culminator 90 arrangement and type are selected in combination with the LED 50 arrangement and type to optimize the width W and intensity of the beam at a selected distance D from the apparatus 20. In one embodiment, the culminators 90 and LEDs 50 arrangements and types are selected so that sufficient energy is absorbed by the curable substance over a predetermined period of time to cure the substance. For example, the culminator and LED arrangements and types may be selected to deliver between about 3.5 Watts per square centimeter ($W/cm^2$) or more of energy to the substance over a converging beam width W between about 1/16 inch and about ¼ inch.

In one embodiment, the light culminators 90 intensify power emitted by the LEDs 50 to between about 2.0 $W/cm^2$ and about 6.0 $W/cm^2$, and more particularly to between about 3.2 $W/cm^2$ and about 3.4 $W/cm^2$. In this embodiment, the energy emitted by each LED 50 is only about 438 milliWatts (mW). Substantially all light emitted from each LED 50 is captured by the light culminators 90 and intensified into a narrow beam. In one embodiment, this narrow beam has a width W of about 3/32 inch.

Figure 7:
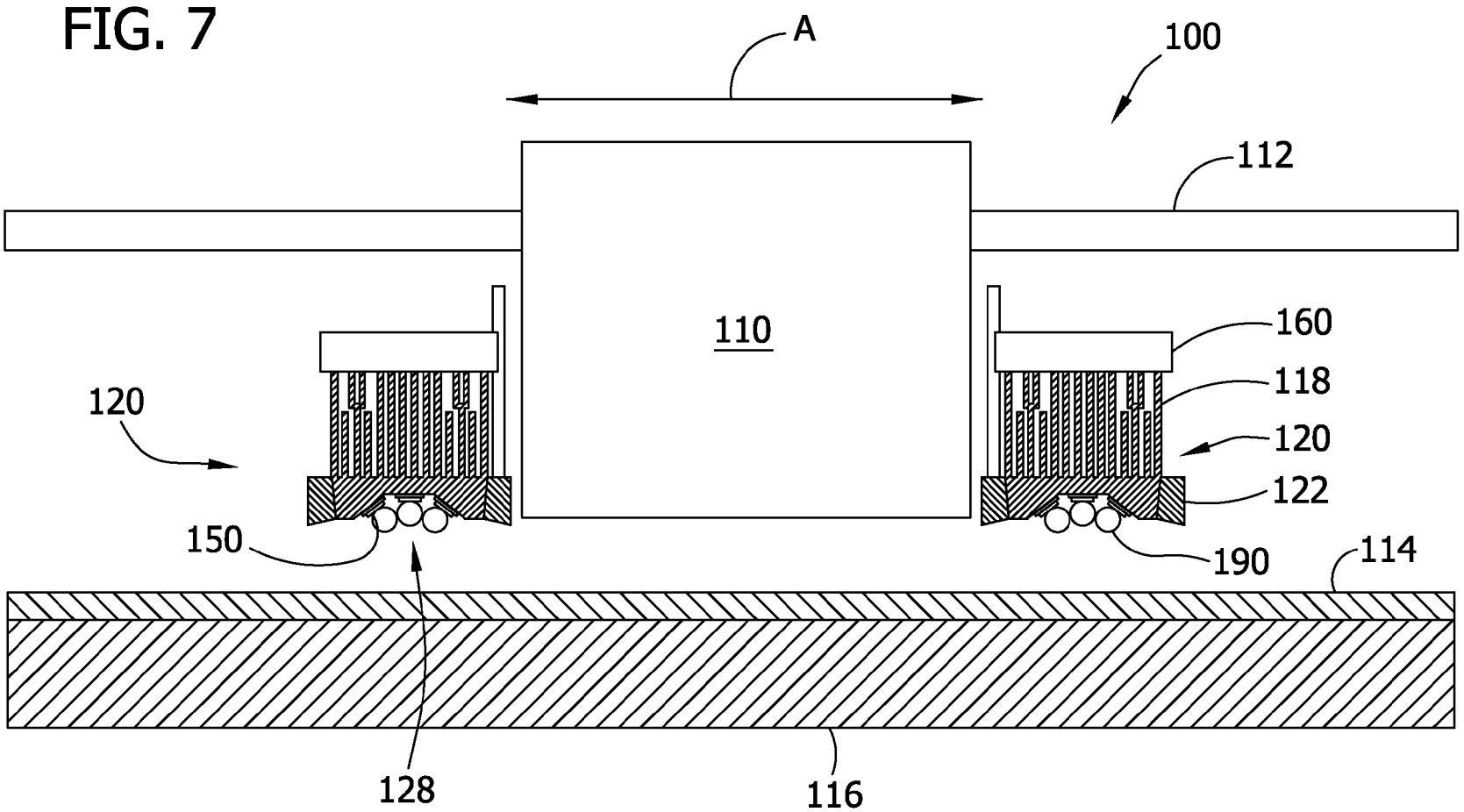
FIG. 7 is a schematic elevation of a printer having two apparatus of a second embodiment of the present invention.

As illustrated in FIG. 7, one application for culminating light-emitting diode apparatus is a printer apparatus, which is generally designated in its entirety by the reference number 100. The printer apparatus 100 includes a printer head 110 mounted on a carriage 112 that moves the head back and forth in the direction of arrow A over a substrate 114 held by a platen 116. The printer head 110 distributes droplets of ultraviolet light curable ink on the surface of the substrate 114 as the carriage 112 moves the head back and forth over the platen 116. Because the printer head 110, carriage and platen 116 are conventional, their features and operation will not be described in further detail. The printer apparatus 110 also includes two ultraviolet light-emitting diode apparatus 120 generally similar to the apparatus 20 described above. Each LED apparatus 120 differs from the LED 20 apparatus described above. The apparatus 120 has conventional cooling fins 118 for dissipating heat and a fan 160 mounted above the fins. Further, each LED apparatus 120 includes a base 122 having a recess 128 formed for receiving three rows of LEDs 150 and three culminators 190. The LED apparatus 120 are mounted on opposite sides of the printer head 110 so they travel back and forth with the printer head. Other features of the apparatus 120 are similar to the apparatus 20 of the first embodiment and will not be described in further detail.

The LEDs 150 and culminators 190 are arranged and selected so they deliver a preselected amount of energy to a preselected area of the ink as they travel back and forth over the platen 116. In one embodiment, in which the carriage travels at a speed of about 200 feet per minute, the LED apparatus 120 each deliver ultraviolet energy at a frequency of about 365 nm over a beam width of about 3/32 inch or more to rapidly cure the ink.

Housings (not shown) may also be provided to surround the bases 22 of the device 20. In one embodiment, inert gas, such as nitrogen, is injected from the apparatus 20 toward the substrate to create an inert gas curtain around the LEDs 50 and substance deposited on the substrate to segregate the substance from surrounding air and to provide an inert atmosphere for curing. The inert atmosphere advantageously removes oxygen from the curing area. During the curing process, the photo initiators in the curable substance will take an oxygen atom from other chemicals in the substance in order to solidify the monomer material. If the curing process takes place in an atmosphere which contains oxygen, the curing process is slowed because the photo initiators take oxygen atoms from the surrounding atmosphere instead of the substance. If oxygen is removed from the curing area, the photo initiators must react with oxygen atoms in the substances instead of oxygen atoms from the surrounding area, thereby increasing the speed of the curing process. The housing may include a plurality of nozzles through which the inert gas is introduced.

In addition to the embodiments described above, apparatus having configurations similar to those described in U.S. Patent Application Publication No. 2007/0184141, which is hereby incorporated by reference, may be used without departing from the scope of the present invention.

Although some of the embodiments described above relate to ink jet printers, those of skill in the art will appreciate that the concentrated energy source may be used in combination with offset printers, flexographic printers, screen printers, gravure printers, pad printers, coating equipment (e.g., curtain, spin and roll coating equipment, drop on demand ink jet printers (e.g., piezo electric, electrostatic and acoustic ink jet printers), continuous ink jet printers (e.g., binary deflection, multiple deflection, micro dot and Hertz ink jet printers), painting equipment and adhesive application equipment without departing from the scope of the present invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for curing a substance comprising:

a body having a recess comprising a plurality of faces, each of said faces extending in a corresponding plane that is tangent to an imaginary cylinder centered on a centerline;

a plurality of diodes, each of said diodes being positioned on one of said faces of the recess so that light energy emitted by each diode is directed toward the centerline of the imaginary cylinder of the faces of the body; and a plurality of culminators, each of said culminators being positioned to receive the electromagnet energy emitted by at least one of said diodes to concentrate and intensify the received energy and to direct the energy toward the centerline of the imaginary cylinder of the faces of the body that in use is coincident with the substance being cured.

2. Apparatus as set forth in claim 1 wherein each of said culminators comprises a rod made from a material that is generally transparent to electromagnetic energy at the frequency selected to cure the substance.

3. Apparatus as set forth in claim 2 wherein said diodes are positioned in rows on the body.

4. Apparatus as set forth in claim 3 wherein each of said rods extends across one of said rows of diodes.

5. Apparatus as set forth in claim 4 wherein each of said rods extends parallel to said faces of the body.

6. Apparatus as set forth in claim 1 in combination with a printer configured to dispense ink on a substrate, said ink constituting the substance cured by electromagnetic energy, wherein said plurality of diodes and said plurality of culminators are mounted to emit the electromagnetic energy and direct the energy toward ink on the substrate to cure the ink.

7. Apparatus as set forth in claim 6 wherein the ink dispensed on the substrate is positioned in a plane coincident with the centerline of the imaginary cylinder of the body.

8. Apparatus as set forth in claim 1 wherein the plurality of diodes positioned on each of said faces of the body are longitudinally offset from those positioned on adjacent faces so the diodes on each face are staggered.

9. Apparatus as set forth in claim 1 wherein each diode is adapted to emit electromagnetic energy in an ultraviolet light frequency range.

10. Apparatus as set forth in claim 9 wherein each rod has a longitudinal axis and is mounted so the axis extends transverse to a direction of travel of the electromagnetic energy emitted by the corresponding diode.

11. Apparatus as set forth in claim 1 wherein the body, diodes, and culminators deliver at least 3.5 watts per square centimeter over a width in a range from 1.59 millimeters to 6.35 millimeters.

* * * * *